US006276460B1

(12) United States Patent
Pahila

(10) Patent No.: US 6,276,460 B1
(45) Date of Patent: Aug. 21, 2001

(54) RESIDENTAL SPRINKLER ARRANGEMENT

(75) Inventor: Oliver S. Pahila, Mount Vernon, NY (US)

(73) Assignee: Reliable Automatic Sprinkler Co., Inc., Mt. Vernon, NY (US)

( * ) Notice: Subject to any disclaimer, the term of this patent is extended or adjusted under 35 U.S.C. 154(b) by 0 days.

(21) Appl. No.: 09/576,922

(22) Filed: May 23, 2000

(51) Int. Cl.[7] ..... A62C 37/08

(52) U.S. Cl. ..... 169/37; 169/41; 169/57; 239/498; 239/504; 239/524

(58) Field of Search ..... 169/37, 41, 57; 239/498, 504, 518, 520, 524

(56) References Cited

U.S. PATENT DOCUMENTS

| | | | | |
|---|---|---|---|---|
| 2,135,138 | | 11/1938 | Kendall . | |
| 4,091,873 | * | 5/1978 | Werner | 239/504 X |
| 5,366,022 | * | 11/1994 | Meyer et al. | 169/37 |
| 5,609,211 | * | 3/1997 | Meyer et al. | 169/37 |
| 5,687,914 | | 11/1997 | Bosio et al. . | |
| 5,839,667 | | 11/1998 | Fishcer . | |
| 5,865,256 | | 2/1999 | Pounder . | |
| 6,026,907 | | 2/2000 | Pahila . | |

* cited by examiner

*Primary Examiner*—David A. Scherbel
*Assistant Examiner*—Steven J. Ganey
(74) *Attorney, Agent, or Firm*—BakerBotts, LLP

(57) ABSTRACT

In the particular embodiment disclosed in the specification, a sprinkler has a sprinkler body with a passage having an orifice providing a K factor of about 3 to 6 which is normally closed by a cap retained in position by a glass bulb thermally responsive element. A deflector spaced from the orifice and supported from the sprinkler body by a pair of frame arms has a circumferential array of tines separated by radial slot-like openings and two openings located in the plane in the frame arms have a length greater than that of the other slot-like openings while four openings located at 45° to the plane of the frame arms are shorter than the other openings. The openings in the plane of the frame arms have a width of about 25% to 75% of the width of the frame arms adjacent to the deflector and a root diameter of about 150% to 300% of the width of the frame arms adjacent to the deflector.

13 Claims, 2 Drawing Sheets

RESIDENTAL SPRINKLER ARRANGEMENT

BACKGROUND OF THE INVENTION

This invention relates to residential sprinkler arrangements and, more particularly, to fast response residential sprinkler arrangements.

The National Fire Protection Association standards NFPA 13D and 13R for residential sprinklers specify minimum flow rates of 9 gallons per minute at a pressure of 9 psi for single sprinklers having a maximum spacing of 6 feet from a wall and 10 gallons per minute at a pressure of 11.1 psi for single sprinklers having a maximum distance of 7 feet or 8 feet from a wall. For two or more sprinklers in the same room having 12, 14 or 16 foot spacings, the minimum required flow rate is 8 gallons per minute at a pressure of 7.1 psi. In order to provide the necessary protection, the distribution of water along the adjacent walls and over the floor area beneath the sprinklers should be substantially uniform.

Various sprinkler arrangements and deflector designs have been proposed heretofore to provide desired water flow rate distribution patterns. For example, the Bosio et al. U.S. Pat. No. 5,687,914 discloses a sprinkler arrangement having a deflector supported from a pair of frame arms which has enlarged tines in the plane of the frame arms with their inner ends bent away from the frame arms and their outer ends inclined slightly toward the frame arms. The Grinnell Model F680 sprinkler has a planar deflector with keyhole-shaped slots distributed around the periphery with the circular part of the keyhole for slots in the plane of the frame arms having a diameter smaller than that of the other slots. Those arrangements, however, do not provide the desired water distribution uniformity for flow rates and pressures of the type mentioned above for residential sprinklers. The Pahila U.S. Pat. No. 6,026,907 discloses one form of residential sprinkler intended to satisfy the water distribution and uniformity requirements.

SUMMARY OF THE INVENTION

Accordingly, it is an object of the present invention to provide a residential sprinkler arrangement which overcomes disadvantages of the prior art.

Another object of the invention is to provide a fast response residential sprinkler arrangement providing highly uniform water distribution at the minimum required flow rates and pressures.

These and other objects of the invention are attained by providing a sprinkler having a sprinkler body with a passage having an orifice which is normally closed by a cap retained in position by a thermally responsive element and a deflector spaced from the orifice and supported from the sprinkler body by a pair of arms and disposed generally in a plane perpendicular to the axis of the passage in which the deflector has a central portion and a peripheral portion with a circumferential array of tines separated by slot-like openings including slot-like openings located in the plane of the frame arms which are substantially longer than the other slot-like openings and preferably have a width in a range from about 25% to about 75%, desirably about 35% to about 65%, of the thickness of the adjacent part of the frame arms and a root diameter in the range from about 150% to about 300%, desirably about 190% to about 260%, of the thickness of the adjacent part of the frame.

Preferably the tines adjacent to the slot-like openings located in the plane of the frame arms have an outer portion which is displaced out of the plane of the deflector in the direction away from the body of the sprinkler with the outer end inclined slightly toward the sprinkler body. In a preferred embodiment, the sprinkler has a K factor in the range from about 3 to 6, and desirably about 4, and the portions of the deflector on opposite sides of the plane of the frame arms each have seven slot-like openings formed between adjacent tines with two openings disposed at about 45° to the plane of the frame arms on each side extending inwardly from the periphery of the deflector to a lesser extent than the other slot-like openings while the other five slot-like openings on each side of the plane of the frame arms have a length intermediate that of the openings in the plane of the frame arms and that of the openings at about 45° to that plane. In order to provide a fast response, the sprinkler preferably has a thermally responsive device in the form of a glass bulb which normally retains the cap in position in the orifice and is designed to release the cap at a relatively low temperature such as about 155° F.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
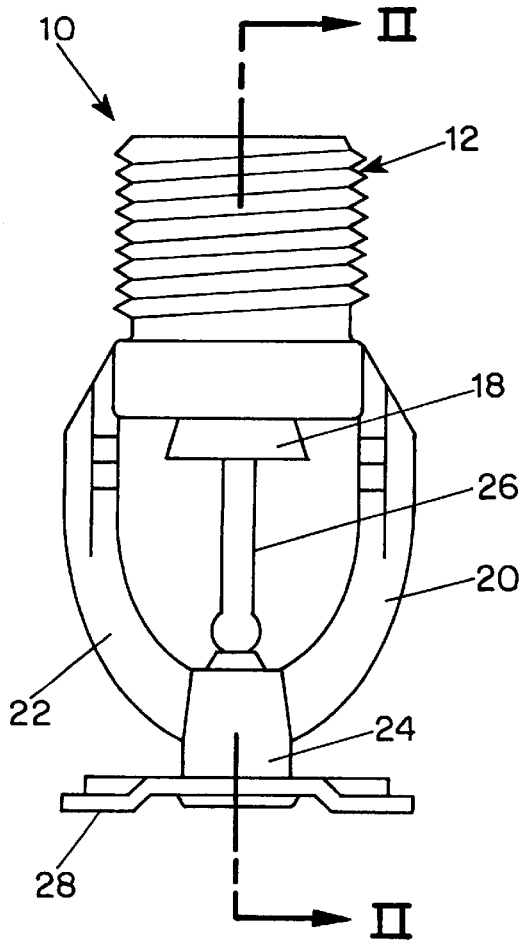
FIG. 1 is a side view illustrating a representative embodiment of a sprinkler arrangement according to the invention.
Figure 2:
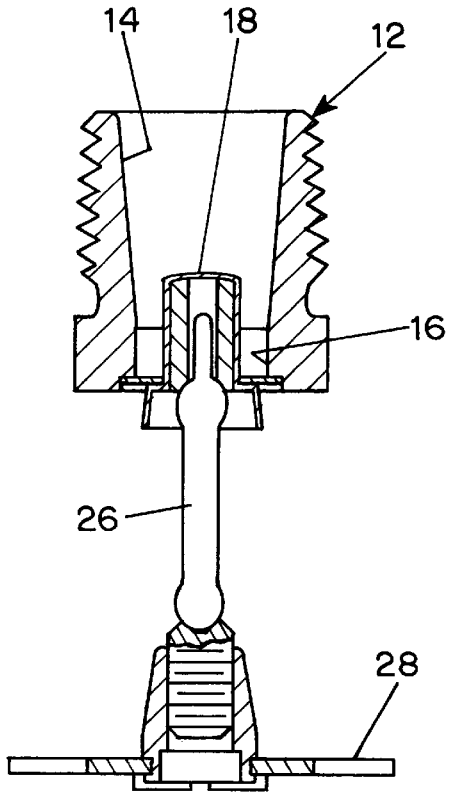
FIG. 2 is a longitudinal sectional view of the sprinkler arrangement shown in FIG. 1, taken on the line II—II therein and looking in the direction of the arrows.

In the typical embodiment of the invention shown in the drawings, a sprinkler arrangement 10 has a threaded body 12 adapted to be connected to a water supply pipe with an axial passage 14 terminating in an orifice 16 which is normally closed by a cap 18. The sprinkler body 12 has a pair of frame arms 20 and 22 extending away from the orifice 16 in the plane of the sprinkler axis and terminating in a boss 24. To normally retain the cap in its sealing position in the orifice 16 preventing water in the passage 14 from being released, a thermally responsive element 26 is positioned between the boss 24 and the cap 18.

To provide a fast response, the thermally responsive element 26 is preferably a glass bulb which is set to break when heated to a temperature of about 155° F., permitting pressurized water in the passage 14 to force the cap 18 out of the orifice 16 and release a stream of water through the orifice. The water passing through the orifice is distributed over an area to be protected by a deflector 28 mounted on the boss 24 in a plane perpendicular to the axis of the passage 14. The sprinkler body 12 is designed to provide a K factor of about 3 to 6 and preferably about 4.

Figure 3:
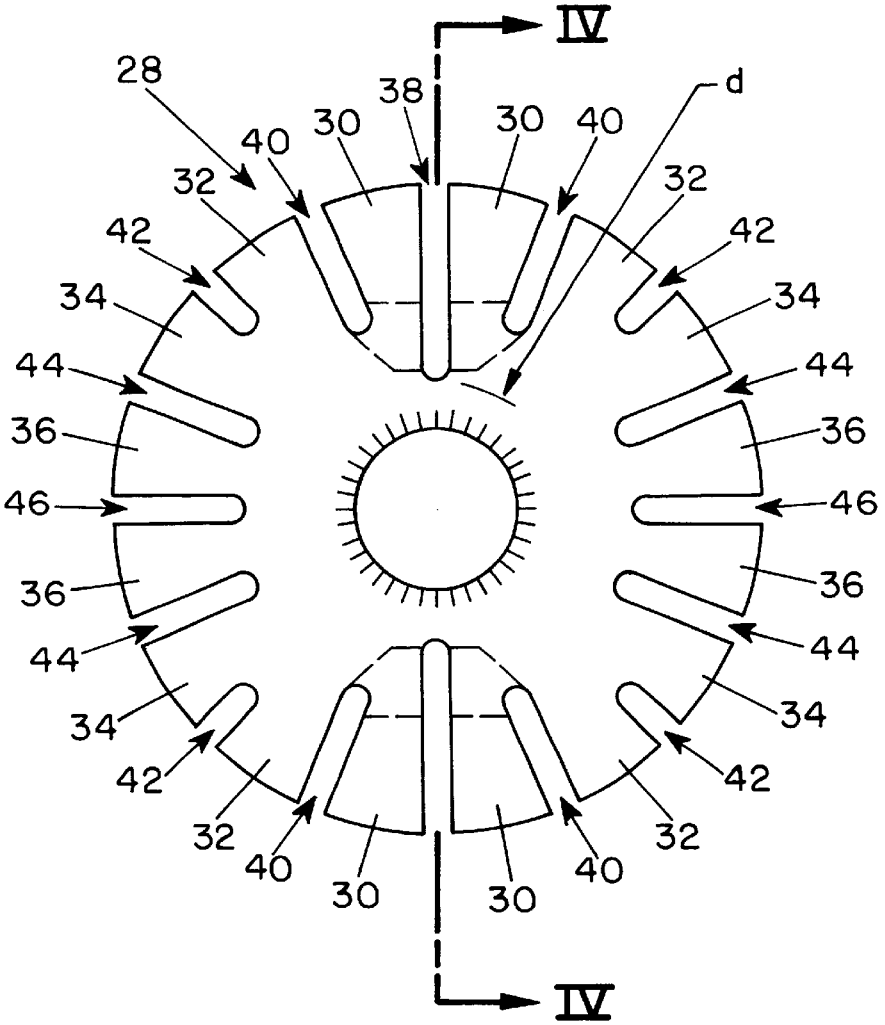
FIG. 3 is an end view illustrating the deflector used in the embodiment shown in FIGS. 1 and 2.

In order to produce a desired uniform distribution of water over the area to be protected, the deflector 28 is formed with a sixteen peripheral tines 30, 32, 34 and 36, separated by sixteen radially extending slot-like openings, 38, 40, 42, 44, and 46 as shown in FIG. 3, identical tines and identical openings being designated by the same reference numeral. The slot-like openings 38, which are formed between the adjacent tines 30 and extend in the plane of the frame arms

20 and 22 have a greater length and extend closer to the axis of the sprinkler than the other openings 40, 42, 44 and 46 and the openings 42 at 45° to the plane of the frame arms are shorter than the other openings. Preferably the openings 40, 44 and 46 have about twice the length of the openings 42 and the openings 38 have about three times the length of the openings 42 and the width of all of the openings is substantially the same.

To enhance the uniformity of water distribution in the plane of the frame arms 20 and 22, the width of the openings 38 is preferably in the range of about 25% to 75%, and desirably about 35% to 65%, of the thickness of the frame arms 20 and 22 in the direction perpendicular to the plane of the frame arms in the region adjacent to the boss 24 and these openings have a root diameter d which is in the range from about 150% to about 300%, and desirably about 190% to about 260%, of the thickness of the frame arms direction perpendicular to the plane of the frame arms in the region adjacent to the deflector. In a preferred embodiment the deflector 28 has a diameter of about one and one quarter inch and the two longest slot-like openings 38 in the plane of the frame arms have a length of about one half inch and a root diameter d of about one quarter inch, the ten medium length slot-like openings 40, 44 and 46 have a length of about three eighths of an inch, and the four shortest slot-like openings 42 have a length of about one quarter inch, all of the slots having a width of about one sixteenth to about one twentieth inch, and preferably about eighteenth inch. The slots are angularly spaced by about 22.5° so as to be uniformly placed around the periphery of the deflector.

Figure 4:
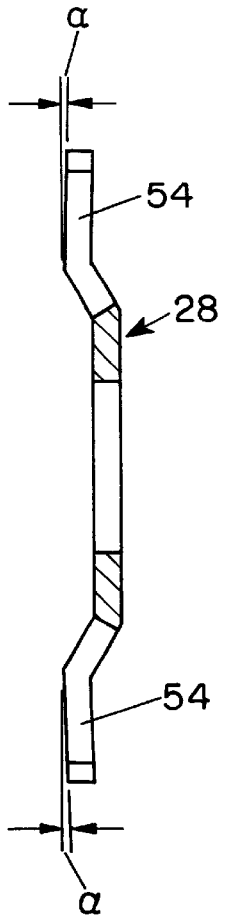
FIG. 4 is a cross-sectional view taken along the lines IV—IV of FIG. 3.
Figure 5:
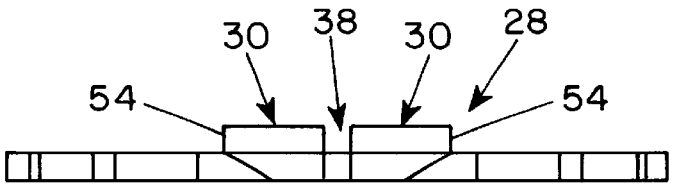
FIG. 5 is an edge view of the deflector shown in FIG. 3.

In this embodiment the tines 30 on opposite sides of each of the longest slot-like openings 38 are formed with end sections 54 which are displaced away from the plane of the deflector 28 by providing two bent portions 56 and 58 as shown in FIG. 4 and 5. These end sections 54 are spaced from the plane of the deflector by about 0.05 inch and they are slightly inclined toward the sprinkler body at a small angle such as 1° to 3° and preferably about 1.5° as shown in FIG. 4.

Although the invention has been described herein with reference to specific embodiments, many modifications and variations therein will readily occur to those skilled in the art. Accordingly, all such variations and modifications are included within the intended scope of the invention.

I claim:

1. A residential sprinkler arrangement comprising:

a sprinkler body having an axial passage for delivery of the extinguishing fluid;

a pair of arms extending from the sprinkler body in a plane generally parallel to the sprinkler axis;

a deflector supported by the pair of arms and disposed generally in a plane perpendicular to the axis of the sprinkler body and having a central portion and a peripheral array of tines separated by radially extending openings each providing a passage through the deflector for fire extinguishing fluid;

the radially extending openings including two openings disposed in the plane of the frame arms on opposite sides of the sprinkler axis which are longer than all of the other radially extending openings.

2. A residential sprinkler arrangement according to claim 1 wherein the width of the openings in the plane of the frame arms is in the range from about 25% to 75% of the thickness of the frame arms in the direction perpendicular to the plane of the frame arms in a region adjacent to the deflector.

3. A residential sprinkler arrangement according to claim 2 wherein the width of the openings in the plane of the frame arms is in the range from about 35% to 65% of the thickness of the frame arms in the direction perpendicular to the plane of the frame arms in the region adjacent to the deflector.

4. A residential sprinkler arrangement according to claim 1 wherein the root diameter of the openings in the plane of the frame arms is in a range from about 150% to about 300% of the thickness of the frame arms in a direction perpendicular to the plane of the frame arms in a region adjacent to the deflector.

5. A residential sprinkler arrangement according to claim 4 wherein the root diameter of the openings in the plane of the frame arms is in a range from about 190% to about 260% of the thickness of the frame arms in the direction perpendicular to the plane of the frame arms in the region adjacent to the deflector.

6. A residential sprinkler arrangement according to claim 1 wherein the radially extending openings further include four radially extending openings disposed in planes extending at about 45° to the plane of the frame arms which are shorter than the other radially extending openings.

7. A residential sprinkler arrangement according to claim 6 wherein the four openings which are shorter than the other radially extending openings have a length which is about one third that of the two longest openings.

8. A residential sprinkler arrangement according to claim 7 wherein the remaining radially extending openings have substantially the same length.

9. A residential sprinkler arrangement according to claim 1 wherein the total number of radially extending openings is sixteen and the radially extending openings are uniformly distributed around the periphery of the deflector.

10. A residential sprinkler arrangement according to claim 1 wherein each of the two openings in the plane of the frame arms is formed by adjacent tines having portions which are displaced from the plane of the deflector in the direction away from the sprinkler body.

11. A residential sprinkler arrangement according to claim 10 wherein the displaced tine portions are inclined toward the sprinkler body at an angle in the range of about 1° to 3°.

12. A residential sprinkler according to claim 11 wherein the displaced tine portions are inclined toward the sprinkler body at an angle of about 1.5°.

13. A residential sprinkler according to claim 1 having a K factor in the range from about 3 to about 6.

* * * * *